US009159303B1

(12) United States Patent
Garrick

(10) Patent No.: US 9,159,303 B1
(45) Date of Patent: Oct. 13, 2015

(54) SLIDE GUITAR

(71) Applicant: Walter Neil Garrick, Thomasville, AL (US)

(72) Inventor: Walter Neil Garrick, Thomasville, AL (US)

( * ) Notice: Subject to any disclaimer, the term of this patent is extended or adjusted under 35 U.S.C. 154(b) by 0 days.

(21) Appl. No.: 14/545,335

(22) Filed: Apr. 23, 2015

Related U.S. Application Data

(60) Provisional application No. 62/176,011, filed on Feb. 5, 2015, provisional application No. 61/995,945, filed on Apr. 24, 2014.

(51) Int. Cl.
*G10D 3/12* (2006.01)
*G10D 3/04* (2006.01)

(52) U.S. Cl.
CPC ... *G10D 3/12* (2013.01); *G10D 3/04* (2013.01)

(58) Field of Classification Search
CPC ..... G10D 1/085; G10D 3/06; G10D 3/00; G10D 1/00; G10D 3/143
USPC ..... 84/267, 297, 290
See application file for complete search history.

(56) References Cited

U.S. PATENT DOCUMENTS 7,557,281 B1 * 7/2009 Campling ..... G10D 3/06 84/293
2006/0144209 A1 * 7/2006 Pieper ..... G10D 3/06 84/293

* cited by examiner

*Primary Examiner* — Kimberly Lockett
(74) *Attorney, Agent, or Firm* — George L. Williamson

(57) ABSTRACT

Slide guitar for providing various improvements and advantages including instant accurate string height adjustments simultaneously at the nut and bridge. The slide guitar has a marked adjustment knob adjacent a graduated scale under the headstock to visually determine with repeated mathematical accuracy the exact distance between the bottom of the strings and the top of the first fret as a point of reference. The improved string musical instrument includes a leveling head embedded into portions of the headstock and neck wherein the leveling head contains a slide selector having a sloped surface for contacting the nut combined with a dual bridge for instantly changing the instrument's string height and bridge type. The slide guitar instantly changes from a conventional type guitar to a steel type guitar creating an improved variable string action slide guitar.

32 Claims, 5 Drawing Sheets

SLIDE GUITAR

RELATED APPLICATIONS

This application claims benefit of U.S. Provisional Patent Application Ser. No. 61/995,945 filed on Apr. 24, 2014.

BACKGROUND OF THE INVENTION

1. Field of the Invention

The present invention relates to improvements in stringed musical instruments of the guitar type and, more particularly, is concerned with a slide guitar with slide guitar selector and dual bridge, including method and apparatus for instantly adjusting the bridge type and string height at the nut and bridge simultaneously to create a variable string action slide guitar.

2. Description of the Related Art

Stringed musical instruments of the past use adjustable nuts and bridges that have been described in the related art; however, none of the related art devices disclose the unique features of the present invention.

In U.S. Pat. No. 8,294,012 dated Oct. 23, 2012, Garrick disclosed a method and apparatus for adjusting the nut of stringed instruments. In U.S. Pat. No. 7,179,975 dated Feb. 20, 2007, Feiten, et al., disclosed a method and apparatus for fully adjusting and providing tempered intonation for stringed instruments. In U.S. Pat. No. 3,971,286 dated Jul. 27, 1976, Borell disclosed a guitar string supporting device. In U.S. Pat. No. 1,571,118 dated Jan. 26, 1926, Hattie disclosed a nut having means for raising the strings from the fingerboard over the frets of a stringed instrument. In U.S. Pat. No. 4,304,163 dated Dec. 8, 1981, Siminoff disclosed an adjustable nut for stringed musical instruments. In U.S. Pat. No. 4,064,780 dated Dec. 27, 1977, Bond disclosed a stringed instrument and a fret board having a saw-tooth surface profile and height adjustable strings. In U.S. Pat. No. 2,309,082 dated Jan. 26, 1943, Smith, et al., disclosed a guitar and guitar nut. In U.S. Pat. No. 1,338,583 dated Apr. 27, 1920, Neft disclosed a nut for guitars or the like.

While these devices may be suitable for the purposes for which they were designed, they would not be suitable for the purposes of the present invention as hereinafter described. As will be shown by way of explanation and drawings, the present invention works in a novel manner and differently from the related art.

SUMMARY OF THE PRESENT INVENTION

The present invention discloses an improved stringed musical instrument for instantly adjusting the height of all the strings at the nut and bridge above the fingerboard to create a variable string action slide guitar. The slide guitar includes a leveling head or housing embedded into portions of the headstock and neck of the stringed instrument. The leveling head contains a slide selector or sliding member having a sloped surface for contacting the nut. When the slide selector is moved to a rearward position the nut and strings are lowered and when the slide selector is moved to a forward position the nut and strings are raised. This slide guitar utilizes the first fret's string height as a point of reference. The slide guitar provides repeatable string action adjustments above the fingerboard with mathematical precision. The slide guitar also includes a cylindrical bridge shaft that has a conventional type radiused guitar bridge located at +180 degrees with a flat conventional steel type guitar bridge located at −180 degrees combined together to provide one dual bridge. When the conventional type bridge is used the strings are in a lowered position and the instrument becomes a conventional type guitar. When the steel type guitar bridge is in use the strings are in a raised position and the instrument becomes a steel type guitar. The slide guitar also includes a marked adjustment knob adjacent a graduated scale disposed on the underside of the headstock for improved visual string height reference. By way of example only, the player of the slide guitar can use the thumb or finger to move the marked adjustment knob connected to the slide selector located adjacent to a graduated scale that is divided incrementally by 10 spaced marks so that the linear distance between each space on the graduated scale is equivalent to 0.010 inches of vertical string distance traveled up or down as the slide selector moves back and forth inside the leveling head. This allows the player to visually adjust instantly the string heights using the first fret as a point of reference between the top of the fret and the bottom of the strings of this improved musical instrument with exact mathematical precision.

The main object of the slide guitar is to provide an improved stringed musical instrument of the slide guitar type having these improvements and advantages for adjusting the string height at the nut and bridge of the instrument with two different bridge types combined into one allowing the guitar player to alternate between a conventional type guitar and a steel type guitar using only one stringed instrument.

A further object of the slide guitar is to enable the player to make multiple string height adjustments on a stringed musical instrument with precise repeatability from an exact lower string height to an exact higher string height so that the instrument can be played in different string actions without changing the instrument being played. A further object of the slide guitar is to adjust the string height of all the strings of the instrument simultaneously using the string height above the first fret as a point of reference. A further object of the side guitar is to allow the string instrument to be playable when the strings are in a lower position or when the strings are in an upper position and for positions intermediate of those upper and lower positions. A further object of the slide guitar is to allow the instrument to be played as a lead or rhythm guitar and then as a slide string action style guitar. A further object of the slide guitar is to provide a method for instantly adjusting string height at the nut and bridge which is easy to use and which can be relatively inexpensively manufactured. A further object of the slide guitar is for precisely adjusting various string heights of the stringed musical instrument which can be accurately changed and visually read while the instrument is being played A further object of the slide guitar is to keep the strings equally spaced apart across the traditional fingerboard to create a variable string action slide guitar. A further object of the slide guitar is to provide repeatable string action levels over and over across the fingerboard of the stringed musical instrument. Another object of the present invention is to allow the musician the ability to adjust the string action instantly at the nut or bridge independently of the other. Another objective of the present invention is to allow the musician to use the marked adjustment knob in tandem with automatic tuning systems so that the player can use the fretting hand's thumb or fingers to push or pull the marked adjustment knob and tuning button to instantly change the instrument's string height and tuning. A further object of the present invention is to use the other string picking hand's thumb or fingers at the same time to flip the dual bridge level over to instantly change the type bridge and bridge string height while playing the instrument. A further object of the present invention is to match different string heights and different tunings for different styles of music such as instantly changing from a low string action lead blues style in E to a high string action steel guitar style in open E.

One of the main advantages of the slide guitar is that the same stringed musical instrument can be used as three different guitars because when the strings are in the lowest position and are closest to the fingerboard the instrument can be used as a lead guitar, and with the strings in the highest position above the fingerboard the instrument can be used as a slide guitar. When the strings are in between the highest and lowest position the instrument can be used as a rhythm guitar.

Another advantage of the present invention, especially when compared to string instruments of the past, is its speed and accuracy combined with the fact that all the instrument's strings are accurately adjusted simultaneously. The improved string instrument is designed to increase the versatility of a stringed musical instrument by providing increased speed and repeated visual accuracy of multiple string elevations allowing for fast manual tuning changes when the player has to manually retune or automatic tuning changes for playing a different string height with different guitar styles while performing live or in the studio.

Another advantage of the slide guitar is that the improved string instrument is ambidextrous. Therefore, the musician can use the left or right hand fretting thumb or finger to pull up or down on a single marked adjustment knob to instantly adjust the level of the strings and push a button to change tuning while using the left or right picking hand to change the bridge type and string height at the bridge up or down across the entire instrument's fingerboard. Another advantage of the slide guitar is the instrument can match the desired playing style and string height, whether it is low string height lead style, moderate string height rhythm style or high string height slide style guitar.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. While an improved electric slide guitar is shown it is not to be construed that the present invention is limited. On the contrary, these improvements that create this variable string action musical instrument could improve many different types of stringed musical instruments. For example, conventional acoustic guitars, steel resonator guitars, and acoustic electric guitars to mention just a few along with other types of stringed musical instruments as well. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
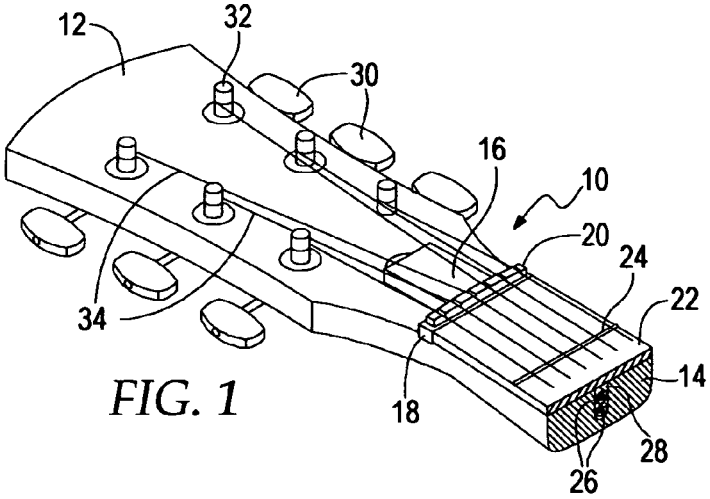
FIG. 1 is a perspective view of the front side of the slide guitar headstock and neck with the slide guitar selector in operative connection.

With regard to reference numerals used, the following numbering is used throughout the drawings.

10 slide guitar selector
12 slide guitar headstock
14 slide guitar neck
16 slide guitar leveling head or housing
18 receptacle
19 cutout
20 nut
21 bottom of nut
22 fingerboard
23 angled surface
24 first fret or frets
26 truss rod
27 truss rod adjustment nut
28 cavity for truss rod
29 mounting block
30 tuning key
32 tuning peg
34 guitar string or strings
36 cutout
38 slot for shaft
40 aperture for tuning keys
42 aperture for fastener
44 marked adjustment knob or member
45 marker
46 shaft
48 graduated scale
50 slide guitar or present invention
52 body
53 dual bridge
54 pickups
55 tailpiece

56 tone/volume control knobs
57 automatic tuning systems
58 3 way selector switch
60 strap buttons
62 lip
64 apertures for fasteners
66 seat for nut
68 slide selector or sliding member
70 threaded end
72 fastener
74 rear end portion
76 front end portion
77 aperture
78 sloping surface
80 upper surface
82 channel
84 sidewall of channel
86 right track
87 left track
88 height of strings
90 finger or thumb
92 base
94 mounting flange
96 aperture
98 bridge fastener
100 receptacle
102 bridge shaft
104 handle
106 arm
108 slot
110 bushing
112 bridge cover
114 cover fastener
116 aperture
118 conventional guitar type bridge
120 steel guitar type bridge
122 notch
124 cam lobe area
126 opening for strings
128 lip area

DETAILED DESCRIPTION OF THE PREFERRED EMBODIMENT(S)

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 18 disclose the improved slide guitar for instantly adjusting string height at the nut and the bridge with the ability to instantly change bridge types from conventional guitar to steel guitar type and is generally indicated by reference number 50.

Turning to FIG. 1, therein is shown a perspective view of portions of the present invention 50 (not shown see FIG. 4) showing the slide guitar selector 10 mounted into the slide guitar headstock 12 and neck 14 of the instrument showing the top portion of the leveling head 16 which forms a housing for the slide guitar selector. The leveling head 16 has a receptacle 18 along with the nut 20 mounted into the receptacle and additionally showing the fingerboard 22 having a first fret 24 disposed along the fingerboard and showing a pair of truss rods 26 disposed in a cavity 28 in the neck for receiving the truss rods. While dual truss rods 26 are shown by way of illustration, other types of truss rods including a single truss rod could also be used with the present invention 50. Also shown are tuning keys 30 having tuning pegs 32 along with the guitar strings 34 of the present invention 50 resting in grooves cut in the top of nut 20 in the conventional manner. Nut 20 is substantially perpendicular to the longitudinal axis of neck 14.

Figure 2:
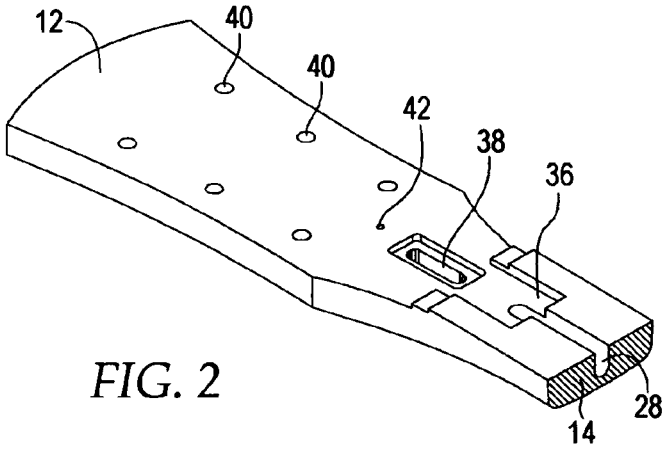
FIG. 2 is a perspective view of the headstock and neck of the slide guitar showing a cutout for receiving the slide guitar selector.
Figure 3:
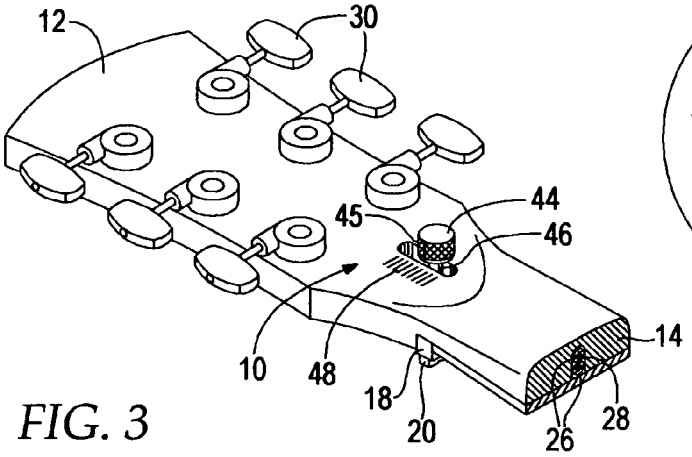
FIG. 3 is a perspective view of the underside of the headstock and neck of the slide guitar showing the slide guitar selector in operative connection.
Figure 4:
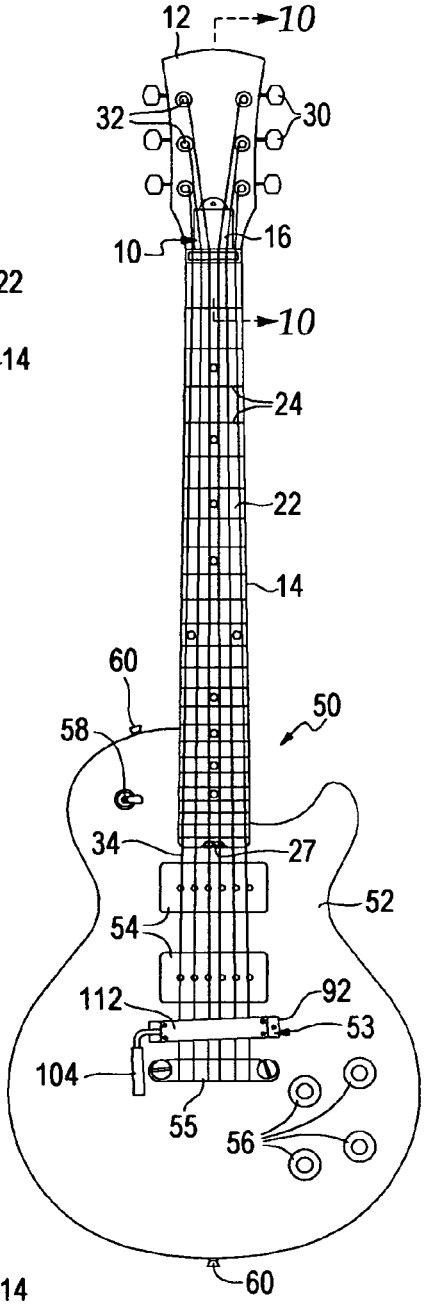
FIG. 4 is a plan view of the front of the slide guitar showing the slide guitar selector and dual bridge in operative connection.

Turning to FIG. 2, therein is shown a stripped away view of the topside of the slide guitar headstock 12 and neck 14 having a cutout 36 disposed therein for receiving the leveling head 16 (not shown, see FIG. 5) of the slide guitar selector 10 (not shown, see FIG. 7) and including the headstock 12 and cutout 36 for receiving the slide guitar selector 10 along with a shaft slot 38 for receiving a shaft 46 (not shown, see FIG. 3) of the slide guitar 50 (as best shown in FIG. 4) and having a plurality of apertures 40 for receiving the tuning pegs 32 along with an aperture 42 for receiving a fastener 72 (not shown, see FIG. 7) to secure the top rear end of the leveling head 16 (not shown, see FIG. 7) onto the headstock 12 of the slide guitar 50. Cutout 36 is complimentary sized and shaped to receive the leveling head 16 therein. It can be seen that cutout 36 is partly in a portion of the headstock 12 and partly in a portion of the neck 14 under the forward end of the fingerboard 22 (not shown see FIG. 1). Also shown is cavity 28 cut into the neck for receiving the truss rods 26 (not shown, see FIG. 3) therein.

Turning to FIG. 3, therein is shown the underside or bottom side of the slide guitar headstock 12 along with the tuning keys 30, the neck 14, truss rods 26, cavity 28 for receiving the truss rods 26 along with a small edge portion of the receptacle 18 and nut 20 of the slide guitar selector 10 along with a marked adjustment knob or member 44 for the string height adjustments connected to the shaft 46 which is used to move a sliding member referred to as the slide selector 68 (not shown, see FIG. 6) contained inside the leveling head 16 (not shown, see FIG. 7) of the slide guitar selector 10 (not shown, see FIG. 7) back and forth within the leveling head 16. Also shown is a graduated scale 48 which is used for visually referencing the height of the strings above the slide guitar's first fret 24 (not shown, see FIG. 1) with marker 45 on the marked adjustment knob or member 44 with respect to slide guitar headstock 12. As the marked adjustment knob 44 slides back and forth along the graduated scale 48 underneath the headstock 12 a musician playing the instrument can quickly and easily visually determine the elevation of the slide guitar strings 34 (not shown, see FIG. 1) by reference to marker 45 and graduated scale 48.

Turning to FIG. 4, therein is shown a plan view of the front of the slide guitar 50 having the slide guitar selector 10 mounted therein along with the body portion 52 having a neck 14 extending between the body 52 and the headstock 12 showing the tuning keys 30 and tuning pegs 32 mounted on the headstock 12 along with the leveling head 16 of the slide guitar selector 10 along with the frets 24 spaced apart along the fingerboard 22 and having guitar strings 34 running from the tailpiece 55 to the dual bridge 53 to the tuning pegs 32 on the tuning keys 30. Also shown are pickups 54 along with multiple control knobs 56 for controlling volume/tone with a three-way selector switch 58 thereon for selecting pickup combinations or the like. Also shown are front and rear strap buttons 60 along with a truss rod adjustment nut 27 of the spoke type that may be used to adjust neck 14 relief if considered necessary. Also shown are the base 92, handle 104, and bridge cover 112 of the dual bridge 53.

Figure 5:
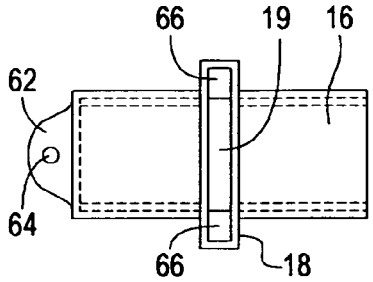
FIG. 5 is a plan view of portions of the slide guitar selector.

Turning to FIG. 5, therein is shown a plan view of the leveling head 16 of the slide guitar selector having a lip 62 on its rear end along with an aperture 64 for placement of a fastener 72 (not shown, see FIG. 7) therein and including a receptacle 18 having seats 66 on each lateral side forming a lower stop upon which the nut 20 (not shown, see FIG. 7) may rest if the slide selector 68 (not shown, see FIG. 6) is removed from leveling head 16. The leveling head 16 has a cutout 19 passing entirely through the receptacle 18 from top to bottom which provides an opening for the top surface 80 of slide selector 68 (not shown, see FIG. 6) to contact the bottom of the nut 21 (not shown, see FIG. 8).

Figure 6:
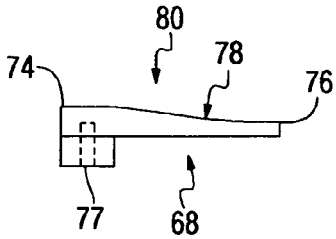
FIG. 6 is a side elevation view of the slide selector.
Figure 10:
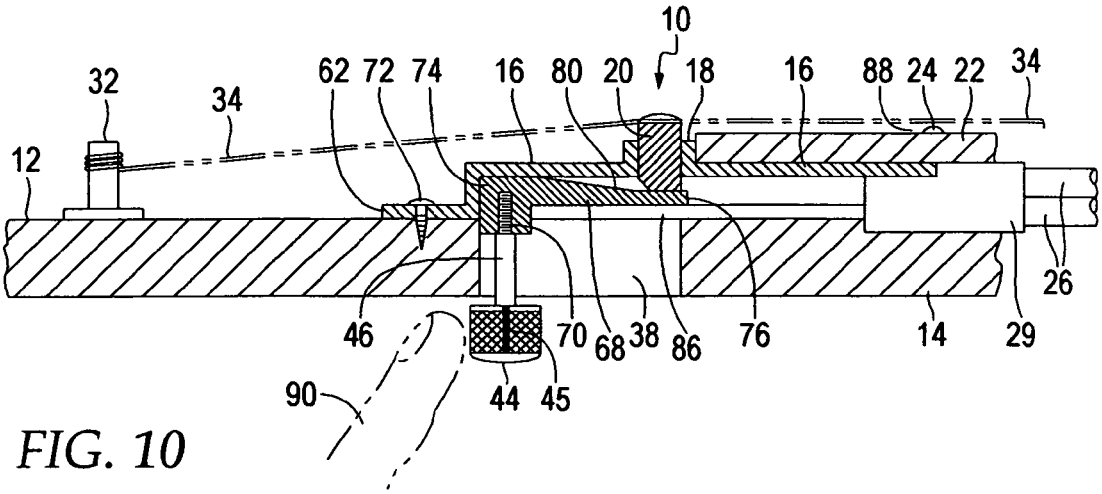
FIGS. 10, 11 and 12 are cross sectional views of the slide guitar selector taken from FIG. 4 as indicated for FIG. 10.
Figure 11:
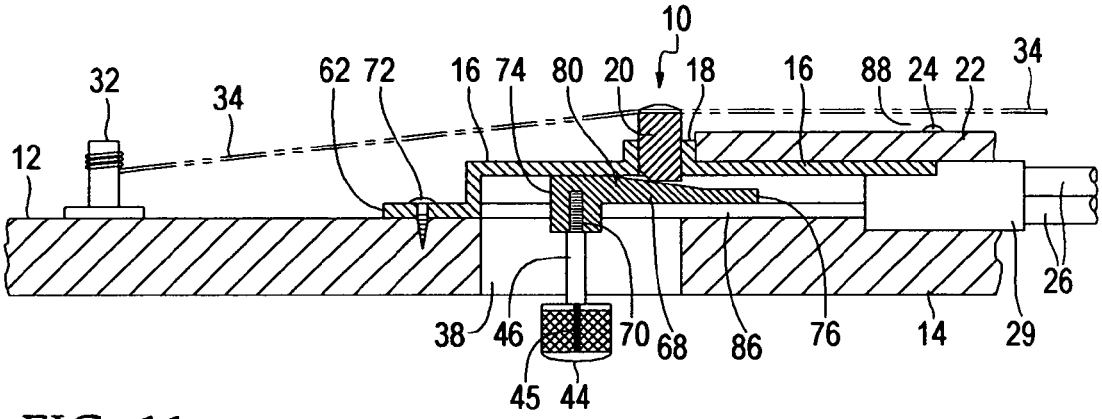
Figure 12:
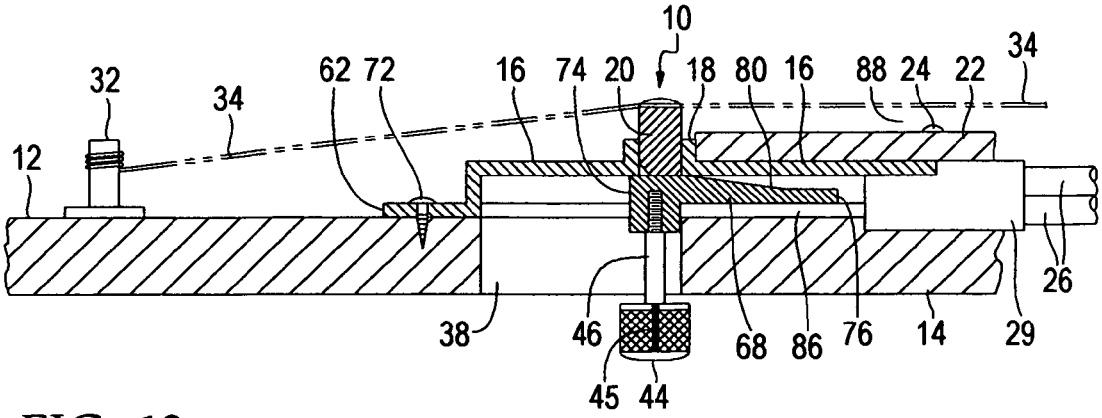

Turning to FIG. 6, therein is shown a side view of the slide selector 68 being thicker on rear end portion 74 and thinner on front end portion 76 and having a sloping surface 78 disposed on its upper surface 80 between its rear 74 and front end portions 76. The precision machined and polished upper surface 80 contacts and smoothly slides along the bottom end 21 of the nut 20 as shown in FIGS. 10-12. Upper surface 80 may be straight or curved depending on the design choice of the builder. Also shown is aperture 77 for receiving a threaded end 70 of shaft 46 (not shown see FIG. 8). By way of example only, the front end portion 76 of the slide selector 68 may be about 0.025 inches thick and the rear end portion 74 may be about 0.125 inches thick providing a maximum string height elevation difference of 0.1 inch, however, many other thicknesses may be used depending on the design choice of the instrument builder. Also it should be noted the slide selector 68 should be manufactured out of a rigid material possessing a low coefficient of friction such as highly polished metals or for example plastics such as DELRIN a type of plastic with a very low coefficient of friction.

Figure 7:
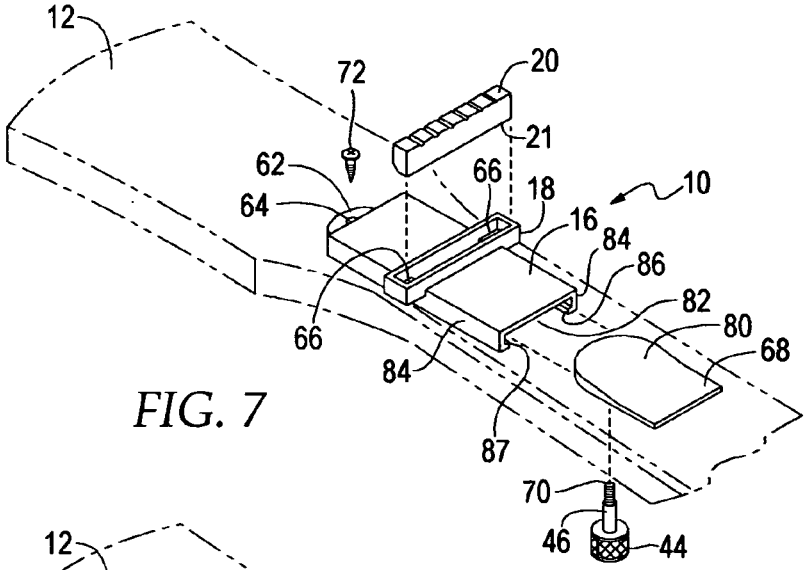
FIG. 7 is an exploded perspective view of the topside of the slide guitar selector.

Turning to FIG. 7, therein is shown the topside exploded view of the slide guitar selector 10 showing the leveling head 16 in which the slide selector 68 slides back and forth underneath the receptacle 18 designed for receiving a nut 20 therein. Also shown is lip 62 disposed on the rear of the leveling head 16 along with aperture 64 for receiving a fastener 72 for securing the rearward portion of the leveling head 16 to the headstock 12 of the guitar. Also shown is the knurled marked adjustment knob 44 for the various string height adjustments having a shaft 46 thereon wherein the tip of its shaft 46 is threaded at 70 for being screwed into mating aperture 77 on the bottom of the slide selector 68 (bottom not shown, see FIG. 8). Seats 66 are also barely visible. Leveling head 16 has a downwardly disposed somewhat U-shaped channel 82 having opposite downwardly disposed flanged sidewalls 84 each having its lower edge turned inwardly toward each other to form a right track 86 and left track 87 upon which the bottom of the slide selector 68 rests as the slide selector 68 moves back and forth in channel 82. The bottom 21 of the nut 20 contacts the top surface 80 of the slide selector 68 as the nut 20 is pressed downwardly by the pressure of the tension of the guitar strings 34 on the nut 20 so that the nut and all of the guitar strings 34 (not shown see FIG. 4) of the instrument are simultaneously and uniformly raised or lowered from one side of the nut 20 to the other side of the nut 20 as the top surface 80 of the slide selector contacts the nut 20 as the slide selector moves back and forth along the right track 86 and left track 87. The center line of motion of the slide selector 68 is substantially parallel to the longitudinal axis of the slide guitar neck 14 of the slide guitar 50 (not shown see FIG. 9) as it slides back and forth.

Figure 8:
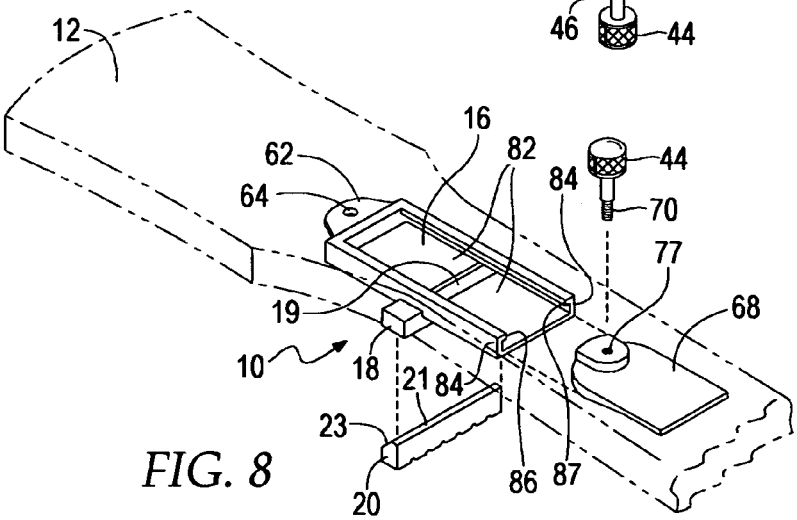
FIG. 8 is an exploded perspective view of the underside of the slide guitar headstock with slide guitar selector.

Turning to FIG. 8, therein is shown the lower side exploded view of the slide guitar selector 10 showing the leveling head 16 having a channel-like space 82 therein for receiving the slide selector 68 which slides back and forth in channel 82 along with the marked adjustment knob 44 for the string height adjustments which has a threaded end 70 for mating into a threaded aperture 77 on lower surface of slide selector 68. Also shown is the lip 62 and aperture 64 therein. Also shown is the nut 20 which rests in receptacle 18 of the leveling head 16 and an angled surface 23 on the back lower end of the nut for making contact with the slide selector 68 smoother. Channel 82, in which slide selector 68 travels, extends substantially the entire length of leveling head or housing 16 and is substantially parallel to the longitudinal axis of the neck of the slide guitar 50 (not shown see FIG. 9) and the direction of travel of slide selector 68, and, substantially perpendicular to nut 20. Other previously disclosed elements may also be shown.

Figure 9:
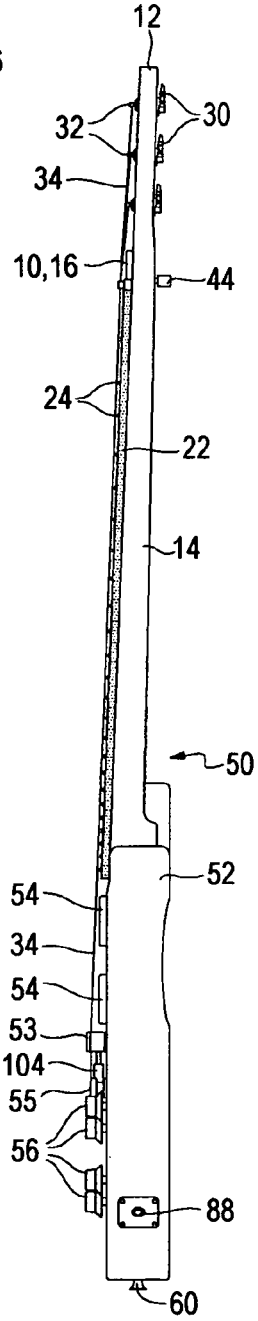
FIG. 9 is a side view of a the present invention showing the slide guitar selector and dual bridge in operative connection.

Turning to FIG. 9, therein is shown a side view of the slide guitar 50 having the slide guitar selector 10 mounted therein showing the body portion 52 having a neck 14 extended between the body and the slide guitar headstock 12 showing the tuning keys 30 and tuning pegs 32 mounted on the headstock 12 along with the leveling head 16 and adjustment knob 44 for the string height adjustments along with the frets 24 spaced apart along the fingerboard 22 and having the guitar strings 34 running from the tailpiece 55 to the dual bridge 53 to the tuning pegs 32 on the tuning keys 30. Also shown are other previously disclosed elements along with a cord jack 88 and strap button 60.

Turning to FIGS. 10 through 12, therein is shown the slide guitar selector 10 mounted into the slide guitar headstock 12 and neck 14 of the slide guitar 50 (not shown see FIG. 4) showing the receptacle 18 of the leveling head 16 with the nut 20 mounted therein along with the slide selector 68 and its marked adjustment knob 44, shaft 46, and threaded end 70 of the marked adjustment knob 44 disposed in the lower portion of the slide selector 68 with marker 45 being visible along with the wall of shaft slot 38. A digit, being a finger or thumb 90 of a left or right hand of a user is also shown in phantom line. Right track 86 is shown underneath slide selector 68. Also shown is the lip 62 of the leveling head 16 along with the fastener 72 being shown. Also shown is a tuning peg 32 along with a string 34 mounted onto the slide guitar headstock 12 with the string passing over the top of nut 20 in a conventional manner. Also shown are the truss rods 26 with mounting block 29 mounted into the neck 14 along with a fingerboard 22 having a first fret 24 mounted thereon showing the front portion of the leveling head 16 mounted underneath the fingerboard and extending into the forward portion of the neck. In FIG. 10, it can be seen that the slide selector 68 is in the most rearward position in leveling head 16 so that the upper surface 80 of its thin front end portion 76 allows the nut 20 to rest thereon so that the strings are in a lowered position when the slide selector is in its most rearward position so that the distance of the strings above the first fret 24 is very small as shown at 88. In FIG. 12, it can be seen that the slide selector 68 is in its most forward position in leveling head 16 so that the upper surface 80 of its thicker rear end portion 74 allows the nut 20 to rest thereon so that the distance of the strings are in a raised position when the slide selector 68 is in its most forward position so that the distance of the strings above the first fret 24 is very great as shown at 88. In FIG. 11, it can be seen that the slide selector 68 is in an intermediate position in the leveling head 16 so that the upper surface 80 of its sloping portion 78 allows the nut 20 to rest thereon so that the strings are in an intermediate position when the slide selector 68 is in its intermediate position so that the distance of the strings above the first fret 24 is moderate as shown at 88. The slide selector 68 could be disposed at many positions along the track 86 of leveling head 16 so that the string height 34 above the first fret 24 could be accurately positioned repeatedly at many different user selected heights on the slide guitar 50 (not shown see FIG. 9).

Figure 13:
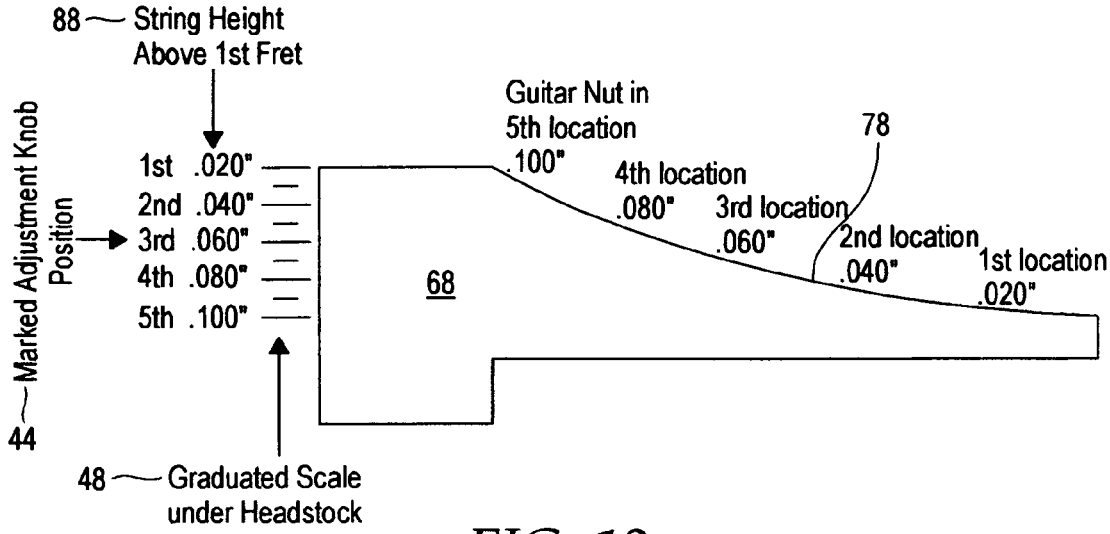
FIG. 13 is an illustration showing the mathematical relationship between the graduated scale on the bottom of the slide guitar headstock and the sloped surface of the slide selector.

Turning to FIG. 13, therein is shown an illustration, provided for example only, showing a side elevation view of slide selector 68, similar to FIG. 6, and provides a visual reference of slide guitar 50 nut locations and string height elevations 88 above the first fret 24 (see FIGS. 10-12) as indicated by the position of the marked adjustment knob 44 adjacent to the graduated scale 48 (see FIG. 3). This demonstrates the mathematical relationship between the graduated scale 48 on the slide guitar headstock 12 of the stringed slide guitar 50 and the sloped surface 78 of the slide selector 68 (see FIG. 6) used for mathematically determining the musical instrument's exact string 34 height above the first fret 24 (see FIG. 1) at various positions of the marked adjustment knob 44 along the graduated scale 48 (see FIG. 3). The graph-like representation in FIG. 13 shows the Marked Adjustment Knob located at the 3rd position adjacent to the Graduated Scale, therefore, the String Height above the 1st Fret would be 0.060 inches. If one moved the Marked Adjustment Knob to the 2nd position, the String Height above the 1st Fret would be 0.040 inches. The teachings of this illustration allow for numerous string height adjustments which can be repeated with pin point accuracy. Sloped surface 78 is shown curved in FIG. 13 but may be planar as shown in FIG. 6.

Figure 14:
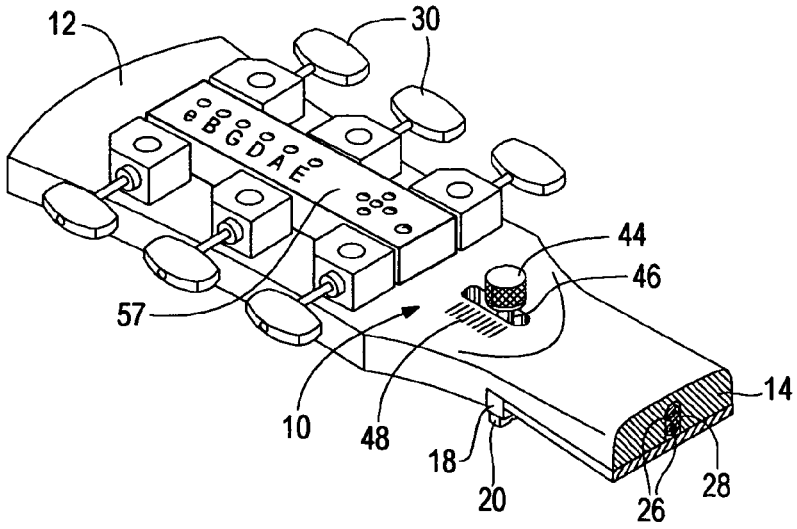
FIG. 14 is a perspective view of the underside of the headstock and neck of the slide guitar showing an automatic tuning system with slide guitar selector and graduated scale in operative connection.

Turning to FIG. 14, therein is shown the underside of the slide guitar headstock 12 as previously disclosed and described relative to FIG. 3 and in addition an automatic tuning system 57 is shown mounted on the underside of the headstock 12 proximate the adjustment knob 44 and graduated scale 48. The automatic tuning system 57 is one of the conventional commercially available types which tunes the strings of a stringed instrument automatically.

Figure 15:
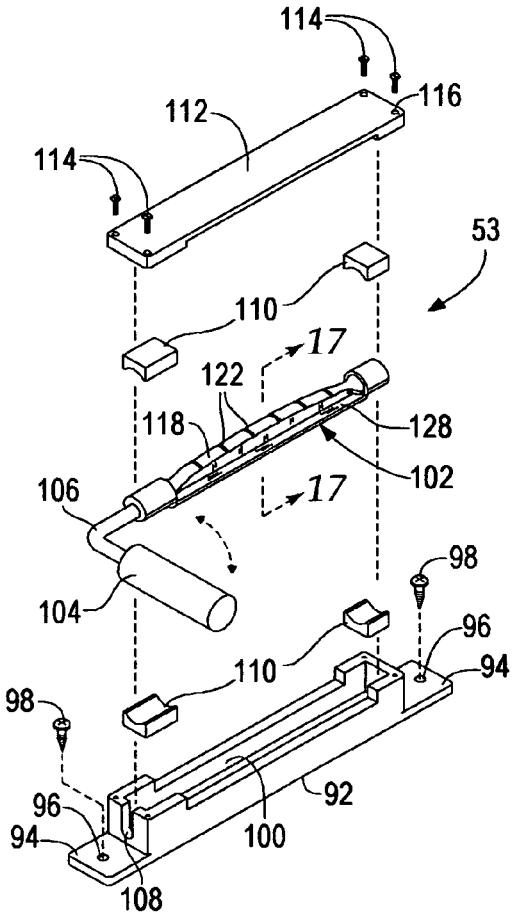
FIGS. 15-16 are exploded perspective views of the dual bridge of the present invention.
Figure 16:
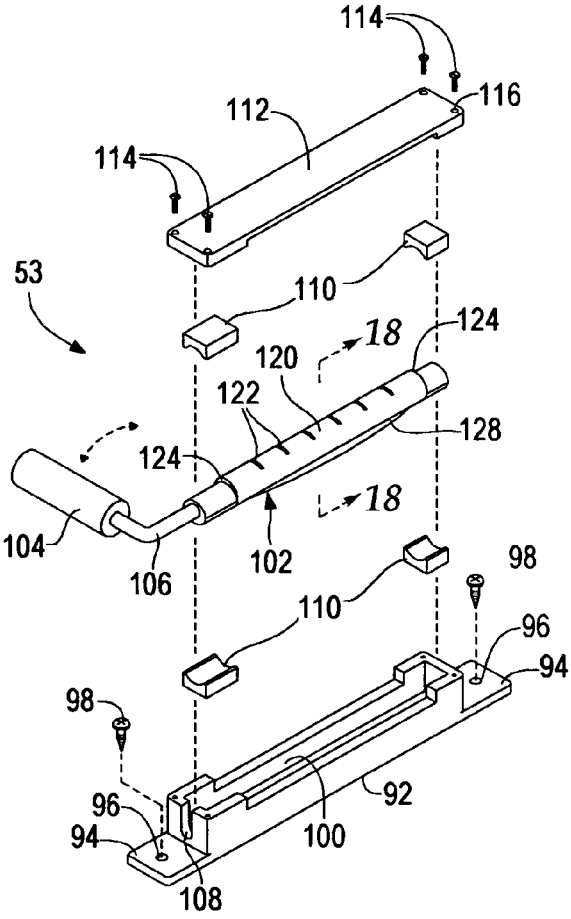

Turning to FIGS. 15-16, therein are shown exploded perspective views of the dual bridge 53 as previously disclosed relative to FIG. 4. Dual bridge 53 includes a base 92 with mounting flange 94 on each end for being mounted onto the front of the slide guitar 50, as shown in FIG. 4, by using fasteners 98 placed through apertures 96. Base 92 has an elongated receptacle 100 thereon which extends generally transversely to the strings, which receptacle contains an elongated rotatable bridge shaft 102 which has a handle 104 connected through arm 106 on one end so that handle 104 can be used to rotate the bridge shaft 102 as indicated by the direction arrow.

Figure 17:
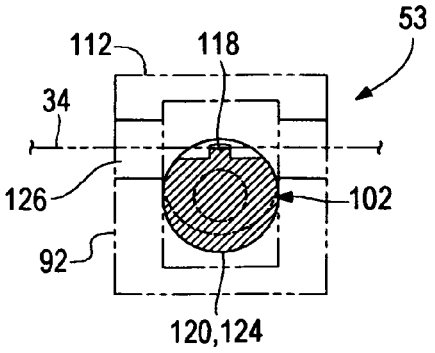
FIGS. 17-18 are cross sectional views of the dual bridge taken from FIGS. 15-16 as indicated.
Figure 18:
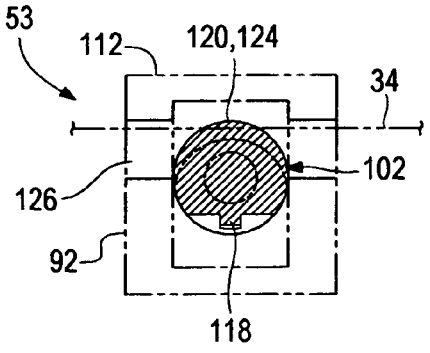

FIG. 15 shows bridge shaft 102 rotated to a first position wherein a conventional type guitar bridge 118 is shown on the upper side for supporting the strings in a lowered position (see item 34, FIG. 17), and, FIG. 16 shows bridge shaft 102 rotated to a second position wherein a steel type guitar bridge 120 is shown on the upper side for supporting the strings in an elevated position (see item 34, FIG. 18). Both surfaces 118 and 120 have spaced notches 122 thereon for receiving the strings therein (see item 34, FIGS. 17, 18). Also, conventional type guitar bridge 118 is expected to have at least a slight crown shape (sometimes referred to as radiused) as is illustrated in FIG. 15 wherein the steel type guitar bridge 120 is substantially flat. In FIG. 16, it can be seen that the increased elevation of the strings caused by the steel type guitar bridge 120 is provided by a cam lobe-like area 124, i.e., an eccentric shape, which is a raised area for raising the strings constructed on each end of the bridge shaft 102 so that the cam lobe area 124 is on the upper end when the bridge shaft 102 is rotated to the second position as shown in FIG. 16. Also shown is top 112 which is attached onto base 92 using fastener 114 along with upper and lower bushings 110 which captures opposite ends of the bridge shaft 102 inside the receptacle 100 so that the bridge shaft can be easily rotated therein and snugly secured inside the receptacle. Also, arm 106 rests in slot 108 in one end of the receptacle 100. Lip area 128 is also shown for defining the conventional type guitar bridge 118.

Turning to FIGS. 17-18, therein are shown cross-sectional views of the dual bridge 53 taken approximately through the mid-point of the bridge shaft 102 as shown in FIGS. 15-16, respectively. FIG. 17 shows the conventional type guitar bridge 118 on the upper side in the first position supporting strings 34 with the cam lobe area 124 on the lower side. FIG. 18 shows the steel type guitar bridge 120 and cam lobe area 124 rotated to the upper side in the second position supporting strings 34 in an elevated position. Note that strings 34 pass through the dual bridge 53 from a front to a rear side by means of an opening 126 disposed between the bridge cover 112 and base 92 of the dual bridge 53.

I claim:

1. A stringed musical instrument comprising an apparatus for adjusting string height of the stringed instrument, the stringed instrument having a body, a headstock, and a neck interconnecting the headstock and the body, and a nut on the neck for providing support for the strings, comprising:

a) an assembly, said assembly capable of being mounted in the neck, said assembly being configured to raise and lower strings of the stringed instrument;

b) said assembly comprising a housing, said housing having a channel therein;

c) a receptacle disposed on an upper surface of said housing, said receptacle for receiving a nut;

d) a sliding member disposed within said housing having an upper sloped surface on which a bottom of said nut can rest, wherein said sliding member is movable within said channel;

e) an adjustment member attached to a bottom of said sliding member; and, f) said adjustment member being movable rearwardly and forwardly along with said sliding member to raise and lower said nut riding on said sloped surface to raise and lower the strings for producing different string actions of the stringed instrument.

2. A stringed musical instrument comprising apparatus of claim 1, further comprising a cutout in a portion of the neck, and, said assembly being disposed in said cutout of the stringed musical instrument.

3. A method for adjusting the string height of a stringed musical instrument, the stringed musical instrument having a body, a headstock, and a neck interconnecting the headstock and the body, and a nut on the neck for providing support for the strings, further comprising the steps of:

a) providing an assembly capable of being mounted in the neck, the assembly being configured to raise and lower strings of the stringed instrument;

b) providing a housing in the assembly, the housing having a channel therein;

c) providing a receptacle on an upper surface of the housing for receiving a nut;

d) providing a sliding member within the housing having an upper sloped surface on which a bottom of the nut can rest, wherein the sliding member is movable within the channel;

e) attaching an adjustment member to a bottom of the sliding member; and, f) moving the adjustment member rearwardly and forwardly along with the sliding member to raise and lower the nut riding on the sloped surface to raise and lower the strings for producing different string actions of the stringed instrument.

4. The method of claim 3, further comprising the steps of providing a cutout in a portion of the neck, and, mounting the assembly in the cutout.

5. A stringed musical instrument comprising an apparatus for adjusting string height of a stringed instrument, the stringed instrument having a body, a headstock, and a neck interconnecting the headstock and the body, comprising:

a) a cutout in a portion of the neck;

b) an assembly mounted in said cutout configured to raise and lower strings of the stringed instrument;

c) said assembly comprising a housing, said housing attached at a first end thereof to the neck for enclosing said cutout;

d) a nut providing support for said strings, said nut mounted on said housing;

e) a sliding member disposed within said housing, said sliding member having an upper sloped surface on which a bottom of said nut rests;

f) an adjustment member attached to a bottom of said sliding member and extending down through said cutout and extending out a bottom side of the headstock; and, g) said adjustment member being movable rearwardly and forwardly along with said sliding member to raise and lower said nut riding on said sloped surface to raise and lower the strings for producing different string actions of the stringed musical instrument.

6. A stringed musical instrument comprising the apparatus of claim 5, wherein a knob is mounted on a bottom portion of said adjustment member, said knob extending below a bottom surface of said headstock, said knob adapted for receiving a digit of a user for moving said sliding member while playing said stringed musical instrument.

7. A stringed musical instrument comprising the apparatus of claim 6, wherein said bottom surface of said headstock adjacent said cutout is marked with a graduated scale for visually referencing height of said strings above a first fret on said neck allowing said user to quickly and easily visually determine elevation of said strings of said stringed musical instrument.

8. A stringed musical instrument comprising the apparatus of claim 7, wherein said nut is seated within a receptacle transversely disposed relative to a top surface of said housing on said stringed musical instrument.

9. A stringed musical instrument comprising the apparatus of claim 8, wherein said adjustment member is threaded at an upper end thereof for releasably engaging said sliding member of said musical instrument.

10. A stringed musical instrument comprising the apparatus of claim 9, wherein said housing has a channel, said channel for receiving and permitting slide movement of said sliding member, said channel having an opening at an end thereof for removal of said sliding member from said stringed musical instrument.

11. A stringed musical instrument comprising the apparatus of claim 10, wherein a center line of motion of said sliding member is substantially parallel to said neck of said stringed musical instrument.

12. A stringed musical instrument comprising the apparatus of claim 11, further comprising an assembly for instantly adjusting the bridge type and bridge height of the stringed musical instrument at the bridge, comprising:

a) a base for being mounted to the front of the stringed instrument, said base defining an elongated receptacle disposed substantially transversely to the strings;

b) a bridge shaft, said bridge shaft being elongated and being rotatably disposed in said receptacle, said bridge shaft having first and second bridge portions for instantly changing the bridge type and bridge height while supporting the strings, thereby instantly raising or lowering the strings at the bridge wherein said second bridge portion is configured to elevate the strings higher in a relatively flat string plane and the said first bridge portion is configured to instantly lower said strings in a radiused or more curved string plane; and, c) wherein said bridge shaft rotates between first and second positions, whereas in said first position said first bridge portion is disposed on the top for supporting the strings, whereas in said second position said second bridge portion is disposed on the top for supporting the strings.

13. A method for adjusting string height of a stringed musical instrument, the stringed instrument having a body, a headstock, and a neck interconnecting the headstock and the body, comprising the steps:

a) providing a cutout in a portion of the neck;

b) mounting an assembly in the cutout configured to raise and lower strings of the stringed instrument;

c) providing a housing in the assembly, the housing attached at a first end thereof to the neck for enclosing the cutout;

d) providing a nut to support the strings, the nut mounted on the housing;

e) providing a sliding member within the housing, the sliding member having an upper sloped surface on which a bottom of the nut rests;

f) providing an adjustment member attached to a bottom of the sliding member and extending down through the cutout and extending out a bottom side of the headstock; and, g) moving the adjustment member rearwardly and forwardly along with the sliding member to raise and lower the nut riding on the sloped surface to raise and lower the strings for producing different string actions of the stringed instrument.

14. The method of claim 13, wherein a knob is mounted on a bottom portion of the adjustment member so that the knob extends below a bottom surface of the headstock, the knob adapted for receiving a digit of a user for moving the sliding member while playing the stringed instrument.

15. The method of claim 14, wherein the bottom surface of the headstock adjacent the cutout is marked with a graduated scale for visually referencing height of the strings above a first fret on the neck allowing the user to quickly and easily visually determine elevation of the strings.

16. The method of claim 15, wherein the nut is seated within a receptacle transversely disposed relative to a top surface of the housing.

17. The method of claim 16, wherein the adjustment member is threaded at an upper end thereof for releasably engaging the sliding member.

18. The method of claim 17, wherein the housing has a channel, the channel for receiving and permitting slide movement of the sliding member, the channel having an opening at an end thereof for removal of the sliding member.

19. The method of claim 18, wherein a center line of motion of the sliding member is substantially parallel to the neck of the stringed instrument.

20. The method of claim 19, further comprising the step of providing an assembly for instantly adjusting the bridge type and bridge height at the bridge of a stringed instrument, comprising the steps of:

a) providing a base mounted to the front of the stringed instrument, the base defining an elongated receptacle disposed substantially transversely to the strings;

b) providing a bridge shaft being elongated and being rotatably disposed in the receptacle, the bridge shaft having first and second bridge portions for instantly changing the bridge type and bridge height while supporting the strings, thereby instantly raising or lowering the strings at the bridge wherein the second bridge portion is configured to instantly elevate the strings higher in a relatively flat string plane and the first bridge portion is configured to instantly lower the strings in a radiused or more curved string plane; and, c) wherein the bridge shaft rotates between first and second positions, whereas in the first position the first bridge portion is disposed on the top for supporting the strings, whereas in the second position the second bridge portion is disposed on the top for supporting the strings.

21. A method for adjusting string height of a stringed musical instrument having a body, a headstock, and a neck interconnecting the headstock and the body, comprising the steps of:

a) using a digit to slide an adjustment member rearwardly and forwardly for moving a sliding member mounted in a portion of the neck to raise and lower a nut supporting strings extending from the headstock to the body, the adjustment member extending from a bottom of the headstock; and, b) using a graduated scale on a bottom surface of the headstock for referencing height of the strings above a first fret on the neck allowing a user to visually determine elevation of the strings.

22. The method of claim 21, wherein the sliding member has a sloping, smooth upper surface on which the nut rides.

23. The method of claim 22, wherein a center line of motion of the sliding member is substantially parallel to the neck of the stringed musical instrument.

24. The method of claim 23, wherein the nut is seated within a receptacle, the receptacle disposed transversely to the neck.

25. A stringed musical instrument comprising an apparatus for adjusting bridge type and bridge height of a stringed instrument, comprising:

a) a base for being mounted to a front of the stringed instrument, said base defining an elongated receptacle disposed substantially transversely to the strings;

b) a bridge shaft, said bridge shaft being elongated and being rotatably disposed in said receptacle, said bridge shaft having first and second bridge portions for instantly changing the bridge type and bridge height while supporting the strings, thereby instantly raising or lowering the strings at the bridge wherein said second bridge portion is configured to instantly elevate the strings higher than said first bridge portion in a relatively flat string plane; and said first bridge portion is configured to instantly lower the strings at the bridge in a radiused or more curved string plane, and, c) wherein said bridge shaft rotates between first and second positions, whereas in said first position said first bridge portion is disposed on the top for supporting the strings, whereas in said second position said second bridge portion is disposed on the top for supporting the strings.

26. A stringed musical instrument comprising the apparatus of claim 25, further comprising a handle disposed on an end of said bridge shaft, said handle for being grasped by a user for rotating said bridge shaft.

27. A stringed musical instrument comprising the apparatus of claim 26, further comprising a plurality of notches disposed on said first and second bridge portions for receiving the strings therein.

28. A stringed musical instrument comprising the apparatus of claim 27, wherein said first bridge portion is radiused and said second bridge portion is substantially flat.

29. A method for adjusting bridge type and bridge height of a stringed instrument, comprising the steps of:

a) providing a base mounted to a front of the stringed instrument, the base defining an elongated receptacle disposed substantially transversely to the strings;

b) a bridge shaft, said bridge shaft being elongated and being rotatably disposed in said receptacle, said bridge shaft having first and second bridge portions for instantly changing bridge type and bridge height while supporting the strings, thereby instantly raising or lowering the strings at the bridge wherein the second bridge portion is configured to instantly elevate the strings higher than said first bridge portion in a relatively flat string plane; and said first bridge portion is configured to instantly lower the strings at the bridge in a radiused or more curved string plane, c) wherein said bridge shaft rotates between first and second portions, whereas in the first position the first bridge portion is disposed on the top for supporting the strings, whereas in the second position the second bridge portion is disposed on the top for supporting the strings.

30. The method of claim 29, further comprising the step of disposing a handle on an end of the bridge shaft for being grasped by a user for rotating the bridge shaft.

31. The method of claim 30, further comprising the step of disposing a plurality of notches on the first and second bridge portions for receiving the strings therein.

32. The method of claim 31, wherein the first bridge portion is radiused and the second bridge portion is substantially flat.

* * * * *